United States Patent [19]

Lord

[11] 4,437,424

[45] Mar. 20, 1984

[54] PARTIALLY RESTRAINED ARRANGEMENT FOR THE MAST AND SAIL OF A CRAFT POSSESSING INHERENT STABILITY

[75] Inventor: Douglas W. Lord, Orlando, Fla.

[73] Assignee: Julian C. Renfro, Winter Park, Fla.

[21] Appl. No.: 507,459

[22] Filed: Jun. 24, 1983

Related U.S. Application Data

[63] Continuation-in-part of Ser. No. 269,486, Jun. 2, 1981, abandoned.

[51] Int. Cl.[3] ..... B63B 15/00

[52] U.S. Cl. ..... 114/91; 114/39; 114/61

[58] Field of Search ..... 114/39, 90, 91, 102, 114/103, 61

[56] References Cited

U.S. PATENT DOCUMENTS

| | | | |
|---|---|---|---|
| 758,171 | 4/1904 | Collins | 114/98 |
| 3,865,061 | 2/1975 | Newman | 114/90 |
| 3,870,004 | 3/1975 | Bailey | 114/39 |
| 3,972,300 | 8/1976 | Adamski | 114/39 |

FOREIGN PATENT DOCUMENTS 2383068 11/1978 France .

*Primary Examiner*—Trygve M. Blix
*Assistant Examiner*—Thomas J. Brahan
*Attorney, Agent, or Firm*—Julian C. Renfro

[57] ABSTRACT

A wind propelled boat of the sailboard type, in which a generally cone-shaped sail mounting member is secured on an upper part of the boat, on the centerline of the boat. A portion of the cone-shaped member is designed to receive the base of the mast of the boat, such that the mast will be movable only for a limited angular extent in the cone-shaped member. Preferably, a mast step tube is utilized in the cone-shaped member, with the base of the mast received in the mast step tube. The mast or mast step tube is secured in the apex of the cone-shaped member, with the arrangement permitting a swivel type motion, with angular deflections of the mast being effectively limited by the cone-shaped member. Preferably, the mast securing arrangement also permits rotation of the mast such that the sail can be reefed. Either an apex up or an apex down version of the cone-shaped member can be employed in accordance with this invention, and a slidable collar arranged to contact interior portions of the cone-shaped member can be utilized on the mast or mast step tube in order that the angle of mast deflection can be selected and controlled within certain limits.

21 Claims, 19 Drawing Figures

12
14
16
17
24
28
29
30
32
34
41
42

PARTIALLY RESTRAINED ARRANGEMENT FOR THE MAST AND SAIL OF A CRAFT POSSESSING INHERENT STABILITY

This application is a continuation-in-part of application Ser. No. 269,486 filed June 2, 1981, now abandoned.

TECHNICAL FIELD

The present invention relates to a generally cone-shaped sail mounting member secured on the deck of a wind-propelled boat, typically of the sailboard type, and serving to limit the angular deflections of the hand held mast of the boat. In the preferred embodiment of my invention, the cone-shaped member is mounted apex down, base up, with a mast step tube arranged to receive the base of the mast being secured in the apex of said cone-shaped member. The connection between the mast step tube and the cone-shaped member is of a nature to permit a swivel type motion such that the mast step tube can approach, during mast motions, one or another of the base portions of the cone-shaped member. The amount of assistance provided the boat user in his support of the sail and mast can be selectively varied in accordance with this invention.

BACKGROUND ART

Anyone who has ever sailed is most aware of the thrill of skimming along the waves, with the wind billowing the sails overhead. Likewise, those skillful enough to use surfboards have enjoyed in recent years, surfboards provided with a hand held mast to which a sail is secured, for these wind-driven devices have such light weight and unusual handling characteristics as to provide the user with a truly breathtaking ride.

The characteristic of a sail driven surfboard is that the user climbs upon the surfboard, and after standing up, proceeds to pull up the sail and mast. The first breeze will then propel the craft along, and the user obtains a ride for as long as his skill and the wind hold up. All of the steering and control is accomplished by means of the sail, and in a craft of the type taught in the 1965 article by S. Newman Darby and in the Schweitzer U.S. Pat. No. 3,487,800, the user holds a wishbone and with it provides the entire restraint of the sail and mast against the wind. A safety feature of the Schweitzer type device involves the fact that should the wind become excessive, the user need only release the wishbone, whereupon the sail drops into the water and high speed travel ceases.

No matter what the skill level of the user of the sail driven surfboard, he or she is destined to fall into the water frequently, such as when the wind changes markedly in either speed or direction, or if the wind dies out entirely, or if the user for any reason loses his or her balance.

Only the more skillful participants are ever able to obtain much enjoyment from a device of the Schweitzer type, for the maintenance of the mast and sail in the proper relationship to the wind is physically very demanding, and good coordination is essential. It was to overcome the limitations and demands of the Schweitzer type device that I was inspired to evolve the present invention.

DISCLOSURE OF THE INVENTION

The present invention relates to a partially restrained arrangement for the mast and sail of a craft possessing inherent stability. Such a craft can include a wide monohull or a trimaran, but is particularly advantageous when utilized in connection with a catamaran whose hulls are bridged by a relatively rigid, arched member known as a cross arm.

Equidistant from the two hulls and located adjacent the forward edge of the cross arm is a cone-shaped member. Movably secured in the cone member in the preferred embodiment is a mast step tube designed to receive the base of a mast to be used with the craft. A connector of a swivel type is utilized for movably securing the mast step tube in the apex of the cone member, with the height or length of the mast step tube being similar to the height of the sidewalls of the cone member. The connector permits a swivel type motion such that the mast step tube can approach, during mast motions, one or another of the base portions of the cone member, with this arrangement advantageously serving to limit deflections of the mast.

In a preferred embodiment of my invention, I utilize a pair of catamaran hulls approximately 14 feet long and possessing sufficient buoyancy that the craft does not heel to any extent, even in a substantial wind. The user grasps a wishbone, and with it holds the mast and sail in the desired position. The cone member prevents the mast and sail from falling into the water, even though the user releases the wishbone. The cone member, whose base portion is intentionally not symmetrical entirely around its perimeter, functions to cause the craft to head into the wind and essentially to come to a stop as a consequence of such release.

I have found that the cone member should be configured to permit the mast to move approximately 28 degrees away from the vertical when it is not being restrained or supported by the user. Rather than provide only this minimal type of restraint, I preferably utilize a collar slidably mounted on the mast step tube, that is designed to interact with the sidewalls of the cone member at whatever height it is adjusted.

When the collar has been slid to a location comparatively close to the apex, the user has less strain to endure, and the user, in a manner of speaking, can relax and enjoy the ride. This is to be contrasted with a craft of the "Windsurfer" type, where the user cannot let up on the stress except to entirely release the sail and mast. However, it is to be noted that when the collar has been adjusted to a position close to the apex of my device, the boat is less maneuverable.

When the collar has adjusted on the mast step tube to a position in which it interacts with the rim or base portions of the cone member, it is easier for the beginner to learn to use the craft, and an optimum balance between stress and maneuverability is obtained. As is obvious, the collar may be adjusted to any location between the upper rim of the cone member and the apex, which collar positioning is of course responsible for bringing about different handling characteristics of the craft.

The user is not limited to use of the collar, for the mast step tube is sufficiently high as to enable the collar on occasion to be slid to a position above the rim of the cone member such that it does not interact with the base or sidewalls of the cone member. The skilled user will typically utilize the collar pushed up to a position out of contact with the cone member, for the greatest maneuverability is obtained in this circumstance. However, it is also true that the greatest stress on the user is manifested when the collar is not being actively employed.

As should be apparent, a number of advantages accrue to the user of my invention, with one of the principal advantages being that only rarely does he or she fall into the water. As a result, my craft can be used throughout several different seasons of the year, and is not limited to use when the water is comparatively warm.

Another advantage of my invention involves the fact that it is comparatively easy to learn to use, for the beginner can be accompanied on the craft by an experienced user, and the operation of the craft explained on a step-by-step basis. As is obvious, many find two people sailing together more enjoyable than sailing alone.

In contrast with the Windsurfer type craft, wherein one size sail must be utilized in a balmy breeze and another size in a stiff wind, my mast is rotatable such that my sail can be wound up during a strong wind, thus to diminish the sail area and making handling of the craft easier.

I make it possible for the user to select any one of four different relationships of the mast to the sail, thereby adding a degree of versatility not possessed by any prior art craft of this general type.

Although in the preferred embodiment of my invention, the generally cone-shaped sail mounting member is mounted base up, apex down, my invention is not to be limited to that arrangement, for the cone member can also be used apex up, base down. Also, if desired, the mast step tube can be eliminated and the base of the mast directly affixed in the apex of the cone.

It is therefore a principal object of my invention to provide a sail boat of the sailboard type, wherein a novel sail mounting arrangement prevents the mast from falling into the water should the user release the wishbone boom.

It is another object of my invention to provide a novel cone-shaped mast mounting arrangement for a sailboard type boat, such as of the catamaran type, wherein the cone-shaped device serves as a support for the mast, and advantageously restrains the mast, sail and wishbone rig to specific operational limits.

It is yet another object of my invention to provide a craft of the sailboard type making possible all of the thrills to be experienced by the use of a sailboard, but which can be utilized without getting into the water, and wherein the strain to be endured insofar as holding the mast in an operational position can be adjusted so as to take into consideration, the strength of the user and weather conditions.

It is still another object of my invention to provide a sail boat of the sailboard type wherein the sail can be readily reefed to several different positions, so as to take wind strength into consideration, without it being necessary to have several different size sails on hand, as was necessary for the full enjoyment of a "Windsurfer" type craft.

These and other objects, features and advantages will be more apparent as the description proceeds.

BEST MODE FOR CARRYING OUT THE INVENTION

Figure 1:
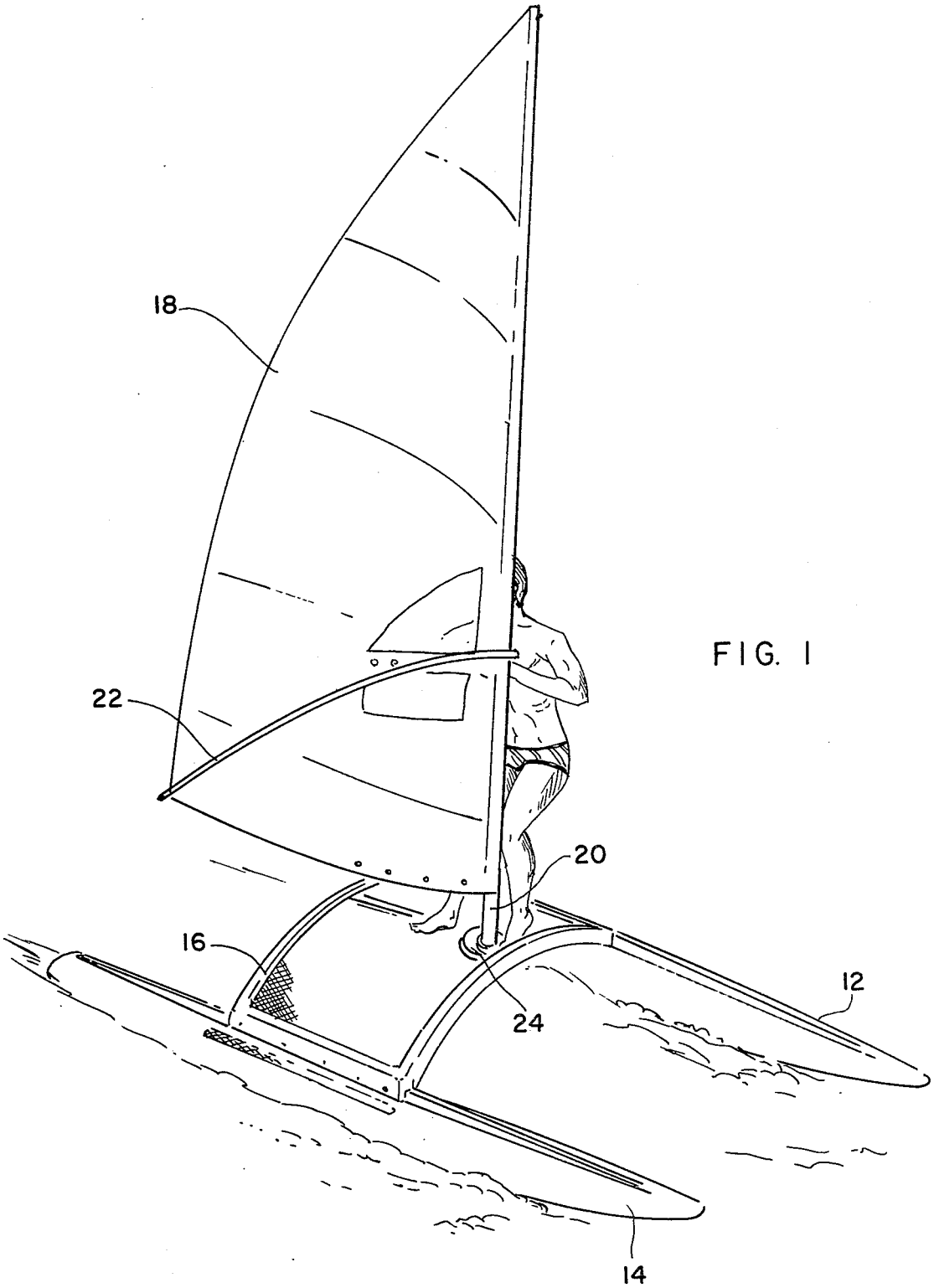
FIG. 1 is a perspective view of my novel catamaran, with the user holding the wishbone of the sail in a typical operational position.

Turning first to FIG. 1, I have there shown a preferred embodiment of my novel arrangement for providing partial restraint for the mast and sail of a watercraft possessing inherent stability. Although my invention can be utilized in connection with a craft utilizing a wide monohull, on a trimaran, or even for an iceboat, I prefer to use a catamaran 10 having hulls 12 and 14 joined together by a relatively rigid, arched member 16 known as a cross arm.

The sail 18 is supported by a mast 20, with the user being provided with a wishbone 22 enabling the mast to be moved into a wide range of positions at the user's behest. The wishbone may be made up of a pair of arcuately shaped tubes secured together at their forward and rear ends, with the forward end releasably attached to the mast in a novel manner explained hereinafter.

Prior art devices of the "Windsurfer" type utilize a mast supported only by a universal type device used at the lowermost point of the mast. As a consequence of releasing the mast so as to decrease the speed of travel over the water, the mast and sail fall over into the water, and typically the rider does likewise.

The Schweitzer et al. U.S. Pat. No. 3,487,800 contains a teaching of the general type of wishbone I may use, although mine is considerably larger due to the greater width of my vessel, and also due to the comparatively large sail area I employ. Of further interest in the Schweitzer et al. patent is the mention that in the event of a sudden surge of wind threatening to capsize the surfboard, the user may release the sail and allow it to fall into the water, thus removing the danger. In accordance with my invention, by way of contrast, a restraint is used such that the sail does not need to fall into the water in order to remove danger.

It is to be noted that the sail 18 is maintained to the desired degree of tautness in the wishbone of my sail by means of an outhaul arrangement consisting of a double block or sheave attached to the rear end of the wishbone. A line or rope from one clam cleat on the wishbone is led through one pulley of the double block to the clew of the sail, then back through the other pulley of the double block, and thence to the clam cleat on the opposite side of the wishbone. The user can readily adjust the sail from either side with this arrangement.

My invention greatly reduces the likelihood of the rider falling into the water by teaching the use of a generally cone-shaped sail mounting member 24 to restrain the movements of the mast. The cone-shaped member is typically located on the forward portion of the cross arm 16, on the centerline of the boat, and in the preferred embodiment is mounted apex down. This cone 24 may be of any of a number of suitable configurations, although I prefer for it to prevent the mast from ever moving more than approximately 28 degrees away from the vertical when the mast is not being restrained or supported by the user. In many instances, however, the cone member can be utilized so as to permit far less excursion from the vertical than this. The cone member and the utilization of the mast therewith will be described shortly, with particular reference to the use of a mast step tube mounted for angular movements in said cone-shaped member.

In use, the rider stands on the cross arm as generally depicted in FIG. 1, grasping the wishbone 22, and thereby positioning the mast and sail in such a manner as to cause the boat to travel at the speed, and in the direction he prefers. As will be explained at length hereinafter, the sail may be rolled up around the mast to a selected degree ("reefed") in the event the wind is quite strong. Also, the amount of restraint provided by the cone arrangement can be selectively varied in order to reflect the skill level of the rider, and to properly accommodate the amount of wind present. Because of the buoyancy and stability provided by the twin hull arrangement, a second rider, even a novice, can easily and safely be carried. The mast is preferably provided with transparent panels in order that the rider or user will have good visibility at all times.

Figures 2, 2A, 2B, 2C:
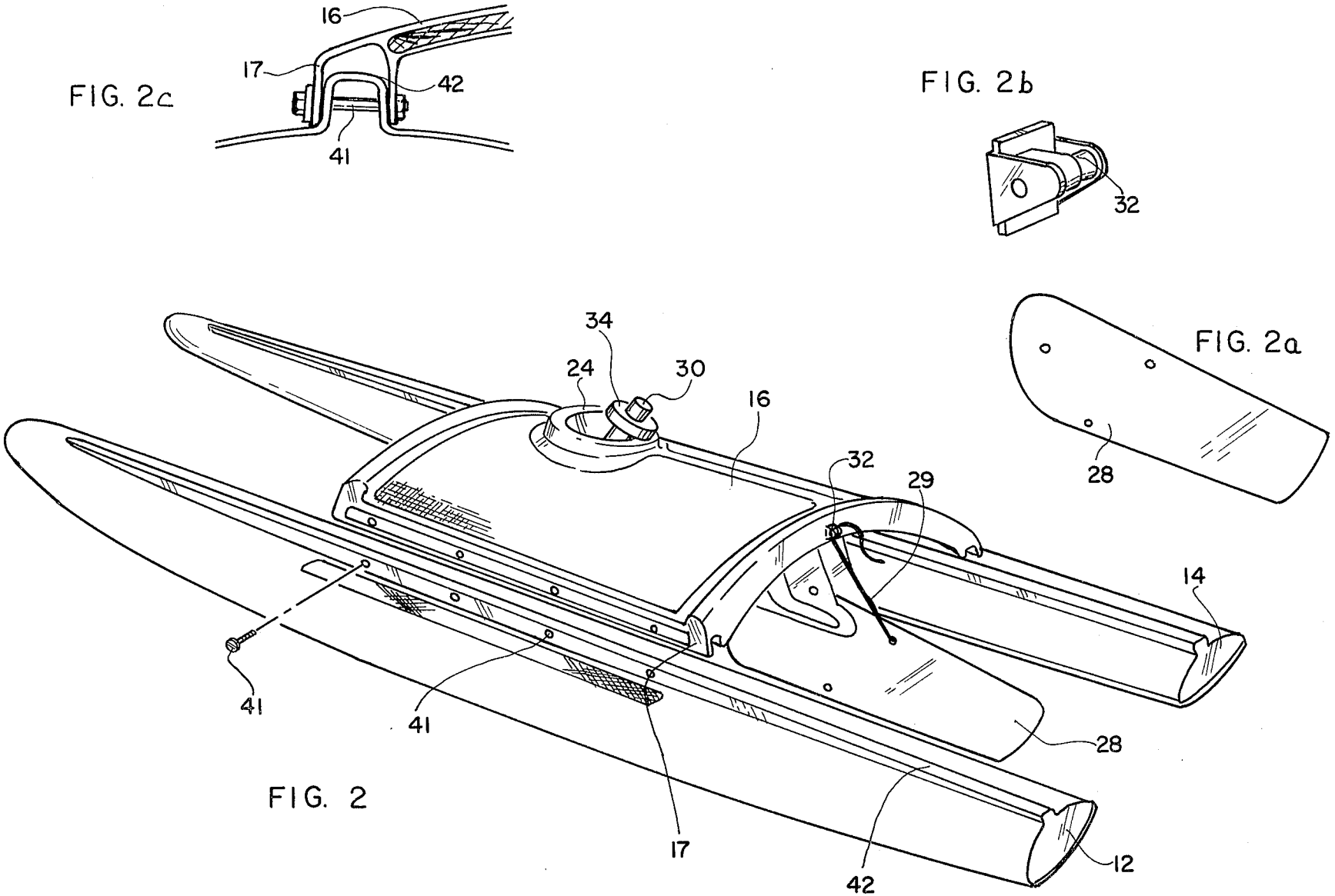
FIG. 2 is a perspective view from a location adjacent the rear end of one of the pontoons, and illustrating the type of centerboard I prefer to utilize.
FIGS. 2*a* through 2*c* are fragmentary views concerned with certain important details of my catamaran.

Turning now to FIG. 2, it will be noted that I have shown the preferred embodiment of my invention in greater detail, including the use of a centerboard 28 hingedly mounted on the rear edge of the cross arm 16, being disposed on the centerline of the vessel. I prefer for the centerboard to be supported about a hole located on the forward part of the centerboard, with a spring means such as a bungee cord attached to the lower portion of the centerboard in order to bias it into its normal position illustrated in FIG. 2. FIG. 2*a* shows the construction of a preferred centerboard. I also prefer to use a lanyard 29 attached to an upper location on the centerboard so that at such time as the boat is to be taken out of the water, the centerboard 28 can be pulled upwardly away from its operative position. A latching means 32 through which the lanyard passes can be utilized on the rear of the cross arm for securing the centerboard in the raised position, with the latching means being operable to readily release the centerboard so that it can return to the operative position as soon as the boat is ready to be returned to use. FIG. 2*b* shows a preferred form of latching means 32.

The pontoons 12 and 14 are typically made of fiberglass and for example may each be 14 feet long. The cross arm 16, also of fiberglass, is provided on its left and right edges with a mounting flange 17 through which four or so mounting bolts 41 can pass in order that each edge of the cross arm can be secured to a ridge 42 extending along the upper part of each pontoon; note FIG. 2*c*. It will be seen in this figure that I prefer to utilize a cross arm with a balsa core.

I prefer for the cross arm to have a width of say 51 inches, for that way the pontoons are spaced far enough apart as to provide the craft with an enormous amount of stability. In many months of extensive testing, even in strong winds, I never found any tendency for the craft to heel to a noticable degree, and certainly a pontoon never lifted out of the water during such trials.

Figure 3:
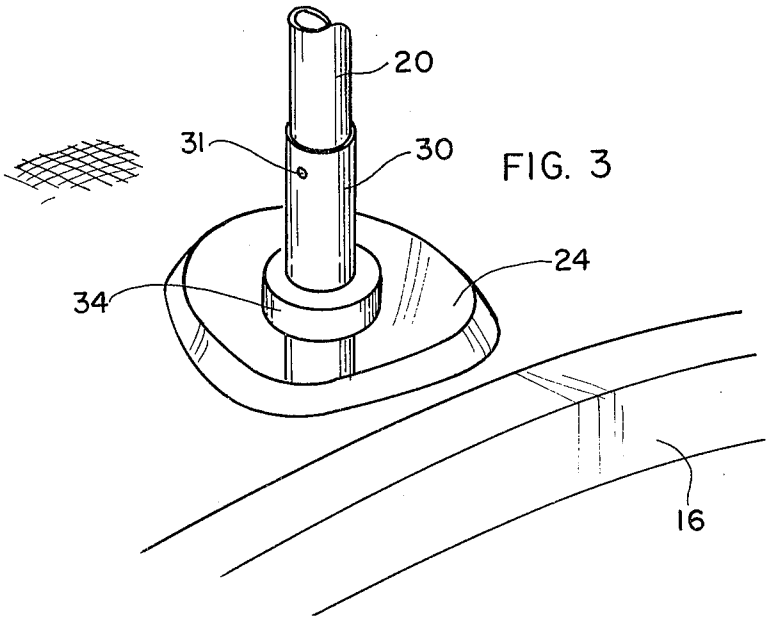
FIG. 3 is a fragmentary perspective view showing certain details of the preferred embodiment of my novel cone and the mast step tube.

The cone-shaped member 24 shown in place in the cross arm 16 in FIG. 3 will be described at greater length hereinafter, but it should be here mentioned that the cone is preferably of fiberglass, and in this preferred embodiment is constructed as an intrinsic part of the cross arm 16. I typically utilize a number of layers of fiberglass cloth in the construction of the cone member, so that it will have ample mast-supporting capability. However, as will be pointed out later, the cone member in some instances may not have complete sidewalls.

As a matter of interest, the forward and aft edges of the preferred form of cone stand approximately $1\frac{3}{4}$ inches higher than the adjacent upper surface of the cross arm 16, whereas on the left and right sides, the cone stands approximately $2\frac{1}{2}$ inches higher than the cross arm. This is explained by the fact that the cross arm possesses curvature whereas the top of the cone is flat.

Although the base of the mast may be directly secured in the apex of the cone, in most instances, I prefer to mount a mast step tube 30 in the cone, which member 30 serves to receive the base of the mast. Although I am not to be limited to any certain materials or dimensions, in an exemplary embodiment of my invention, I constructed both the mast and the mast step tube of 6061-T6 Aluminum. When using an 18-foot mast, the mast step tube 30 had an outside diameter of $2\frac{1}{4}$ inches, had an inside diameter of 2.084 inches, and was 14 inches high. The base of the mast had a 2-inch outside diameter and an inside diameter of 1.834 inches.

A slidable collar 34 movable vertically into any of a wide range of positions on the step tube 30 may be provided, which collar will be in contact with the desired portion of the interior sidewalls of the cone member during tilting of the mast. The collar can also be moved to a raised position in which the collar does not contact the inner surfaces of the cone member, for reasons to be later described. The collar is preferably made of polyurethane, and fits tightly enough on the step tube as to reside in a non-slip manner in whatever position it is placed. However, the collar is an optional feature, and some users prefer to eliminate it.

Figure 4:
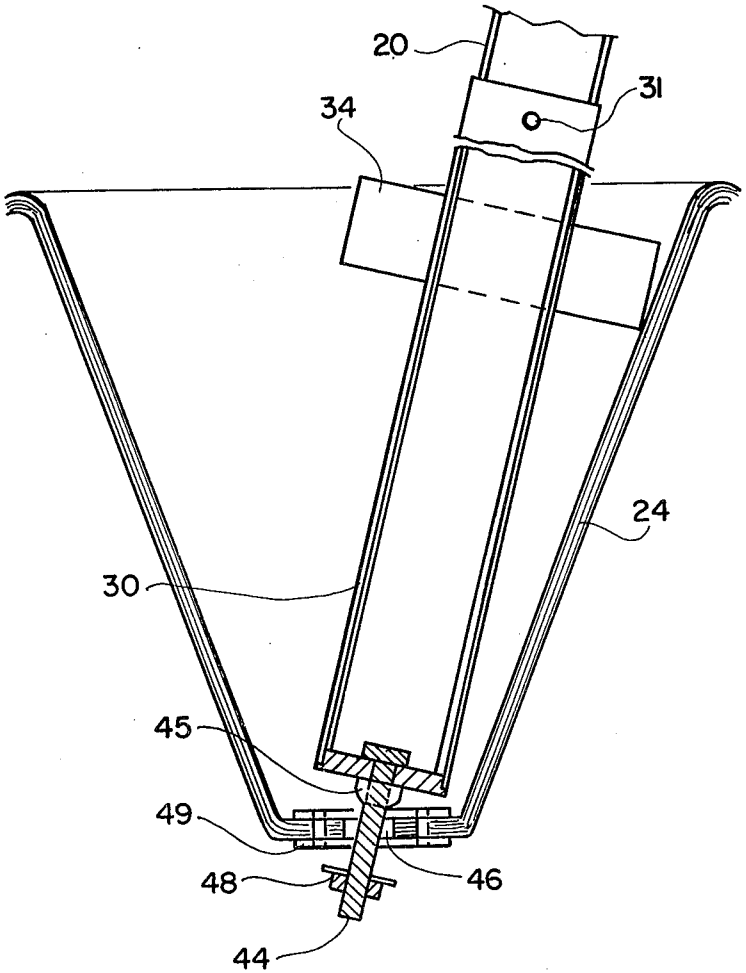
FIG. 4 is a side elevational view to a larger scale with the cone cut away to show the manner in which the step tube is secured in an easily swiveled manner in the cone.

Referring to FIG. 4, it will be seen that the exemplary form of cone member is relatively deep and provided with a hole at the bottom. For example, the cone member can be $10\frac{3}{8}$ inches deep, and its base, uppermost in this instance, can be $10\frac{3}{4}$ inches across. A downwardly extending bolt 44 is secured at the bottom of the mast step tube 30 such as by a standard $\frac{3}{8}$ inch lock nut 45 of stainless steel. After the bolt 44 has been inserted through the hole 46 in the bottom or apex of the cone member, a nut 48 is threaded onto the threads of the bolt, but is not tightened. Because of this, the bolt functions as a type of swivel connection, permitting the mast step tube, and therefore the mast, to be moved to a wide range of positions away from the vertical, and also permitting the mast to be twisted during a later-described reefing operation. A ⅜-inch bolt of stainless steel, which for example may be three inches long, may serve as bolt 44, the head of which bolt is firmly secured in the base of the mast step tube.

I prefer to minimize any possible damage to the cone by utilizing a stainless steel washer 49 on both sides of the hole 46, and for example each washer may be 2¾ inches in diameter. The washers are secured in position by small bolts. Because the nut 45 interacts with the upper washer 49, any premature wearing of the base of the mast step tube is prevented.

By the collar member 34 being slidable along the mast step tube 30, the rider is able to control the location on the cone at which support is provided for the mast, and in that way he can select how much assistance he wishes the cone to provide in a given circumstance. The mast step tube is provided with a hole 31 through which a pin can be slid when the mast 20 is to be affixed to the step tube 30.

When the collar 34 is in the position shown in FIG. 4, an optimum balance between stress to be endured, and maneuverability is achieved, and I have found it easier for a beginner to learn to use my craft with the collar in this position, than in any other position. The mast may be tilted approximately 13° away from the vertical when the collar is in this high location.

When on the other hand the user wishes to be relieved of more strain, he can slide the collar downwardly to a location nearer the apex of the cone. Although the operator can be much more relaxed in his efforts, it is to be noted that the craft then becomes less maneuverable, and the operator has a somewhat diminished amount of control. By forcing the collar close to the bottom of the cone, the mast can be locked in the vertical position, but this is typically done only at time of storage.

It is to be noted that the mast step tube 30 extends a few inches higher than the top of the sidewalls of the cone member 24, and this enables the collar to be slid upwardly to a position in which it is out of contact with the cone member. As can be anticipated, when the collar is not in a functioning position, the cone is able to contribute support for the mast only when a sizable mast tilt has occurred, with this tilt being on the order of magnitude of 28 degrees. As should be apparent, only minimal restraint is now placed upon movements of the mast, and hence the greatest maneuverability is obtained with the collar out of play. I may use a band of plastic around the mast step tube at the location at which the base of the cone-shaped member (the uppermost part in this instance) will be contacted, to minimize wear.

Figure 5:
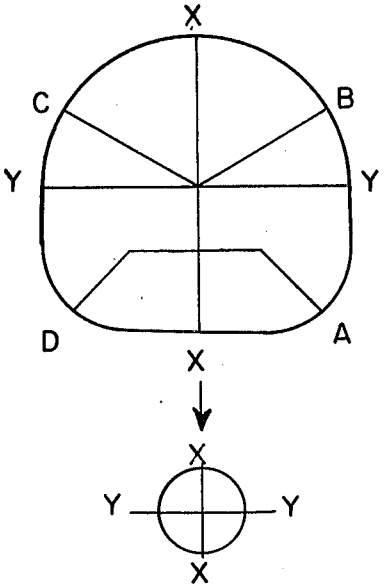
FIG. 5 is an exemplary plan view of the cone configuration, with the quadrants of the base of the cone identified for convenient reference.

Referring to FIG. 5, it will be noted that the cone is preferably not symmetrical, but rather the base is comparatively pointed at its aft portion, and relatively straight across the front portion. I am not to be limited to such, but in a preferred embodiment, the rear half of the cone was created at a radius of 5⅜ inches, whereas the left front and right front corners of the cone preferably are created on a three-inch radius.

It will be noted that I have applied the letters A, B, C and D to the base part of the cone member as illustrated in FIG. 5. Quadrant A and Quadrant D, which are symmetrical, allow for the fullest sideways movement of mast step tube when the tube 30 is angled forward by user to effect a downwind course change. For downwind sailing, the mast step tube with mast inserted will be moved along the forward edge of the cone from one side to the other, that is, between Quadrants A and D. For sailing any direction but downwind, the movement of the mast step tube with collar and mast inserted and under user control will be along the top few inches of the cone device (depending on collar adjustment) from Quadrant D to Quadrant C, or vice versa, when the wind is coming from the portside. The type of movements used depend on the wind, and the operator. When the wind is on the starboard side, mast movements will be between Quadrants A and B.

Quadrants B and C have a greater radius than Quadrants A and D because no degree of athwartship movement between them in a straight line is required. In the absence of user control, when the collar has been adjusted in the 10°–28° range, the cone will cause the mast to move aft, creating a tendency for the catamaran to head into the wind, losing headway. This is a significant safety feature.

As should now be apparent, in order for the operator or rider to control the direction of travel of the boat, he brings about a tilting of the mast by a suitable manipulation of the wishbone 22. This causes the center of pressure of the sail 18 to move with respect to the centerboard 28, and thereby brings about a turning into the wind or a turn away from the wind, depending upon the direction of the mast tilt.

Turning to related FIGS. 6*a* through 6*d*, it may be seen that viewed from above, the interior of my novel cone-shaped member may be generally triangular, with the forwardmost interior portion being relatively straight. This front portion of the cone-shaped member merges preferably by the use of rounded contours with interior portions on each side of this front portion. The side interior portions angle rearwardly and meet in a rounded location on the aft center of the cone-shaped member. Although I am not to be limited to such, I prefer for the rounded portion on the aft center to be of a larger radius than the radii of the rounded contours existing between the relatively straight forward portion, and the adjacent side interior portions of my cone-shaped member. As previously indicated, the radius of the aft center of this generally triangular portion of my generally cone-shaped member may be created at a radius of 5⅜ inches, whereas the radii between the front and side portions may be 3 inches.

Figure 6A:
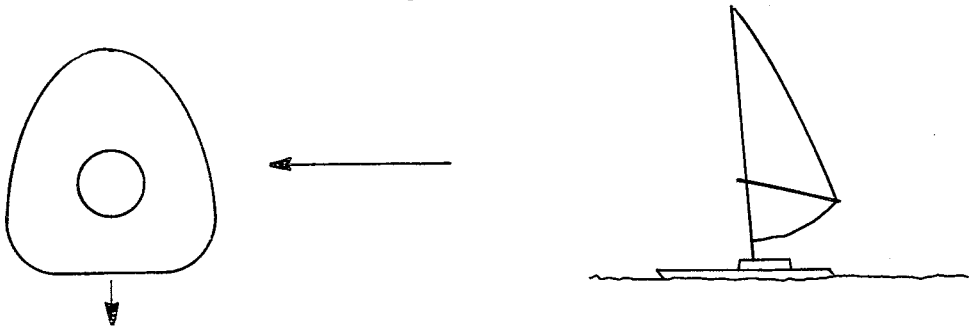
FIGS. 6*a* through 6*d* represent sail positions associated with various positionings of the mast step tube.

As an example of the positioning of the mast step tube 30 with respect to the cone during specific sailing conditions, reference should first be had to FIG. 6*a*, wherein the mast is slightly tilted forward and the mast step tube is located just forward of the middle of the cone 24. In this instance, the center of effort of the sail is almost directly above the center of lateral resistance offered by the centerboard, and hence, the craft sails in a straight line direction.

Figure 6B:
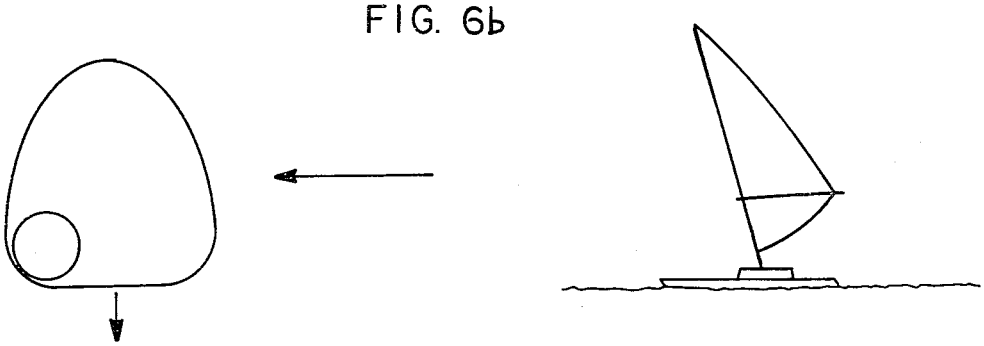

Next, with reference to FIG. 6*b*, it will be noted that the mast step tube has been moved to a forward corner of the cone remote from the wind, resulting in a forward tilt of the mast, and a turn away from the wind.

Figure 6C:
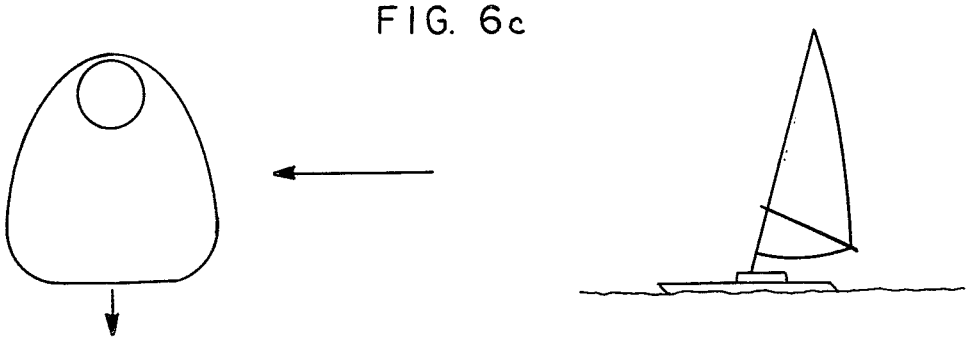

The opposite result is obtained as shown in FIG. 6*c* by pulling the mast step tube rearwardly. This causes the sail to tilt rearwardly and the craft to turn into the wind.

Figure 6D:
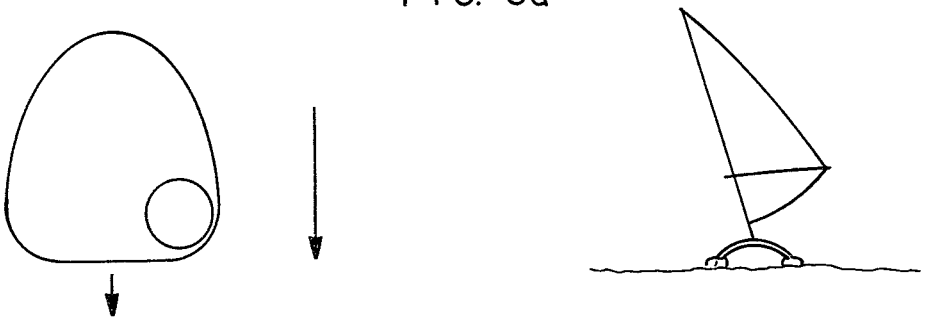

FIG. 6*d* reveals the arrangement at the time of downwind sailing, and in this instance the mast step tube has been moved to a position in the forward part of the cone, into a position farthest from the wind.

Figure 7:
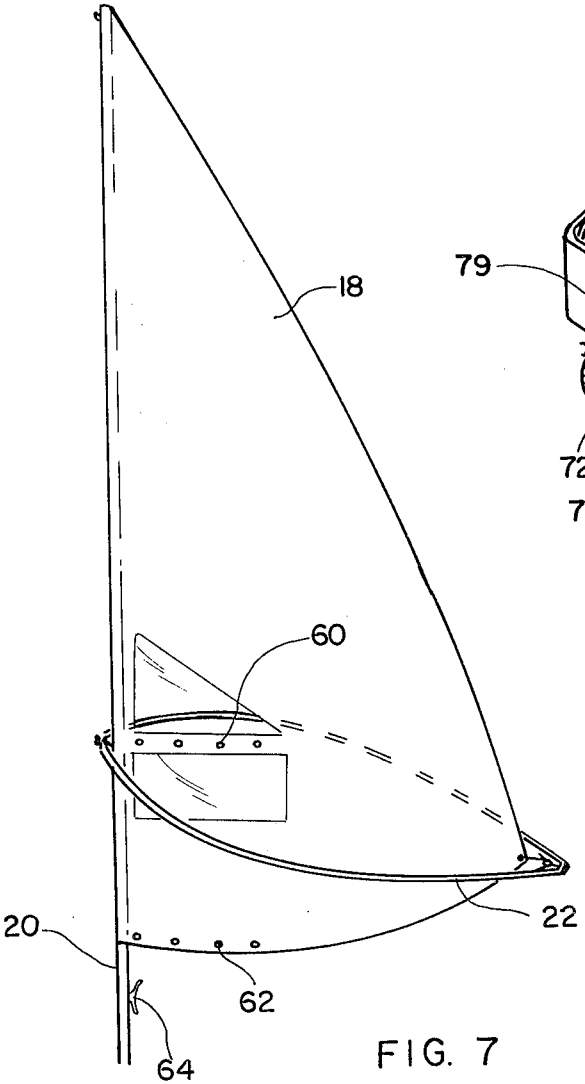
FIG. 7 is a side elevational view of the preferred form of sail, with certain holes provided in the sail being called out.

Turning now to FIG. 7, it will be seen that I have shown the sail 18 mounted on the rotatable mast 20, with the wishbone 22 attached to the mast in approximately the correct operational position. It will be noted that I have provided an aligned series of holes 60 in the forward part of the sail 18, these being in the approximate location of the wishbone, which holes I refer to as reef points. I also utilize another series of holes 62 known as downhaul positions, in the lower part of the sail.

As is known, when sailing in strong wind, it is often desirable to be able to reef the sail to a certain extent, so as to diminish the effective sail area. This is of course much easier to accomplish than having to change to a different sail.

Rather than utilize a ponderous reefing procedure, I have provided the series of holes 60 in alignment with the fitting on the mast designed to receive and support the forward portion of the wishbone 22. At such time as the wishbone has been removed, and the mast rotated so as to cause the sail to be partially wound therearound, the mast-supported mounting pin upon which the wishbone is to be mounted appears at the first hole 60. In a manner to be described shortly, the wishbone can then be reattached, or if the wind is too strong for that much sail area, the mast can be rotated to an additional extent, until the wishbone mounting pin reappears at the second hole. As is obvious, by rotating the mast, the user can cause the wishbone mounting pin to appear at a selected one of the four holes 60, such that the resulting sail area is appropriate for the particular wind condition.

Figure 10:
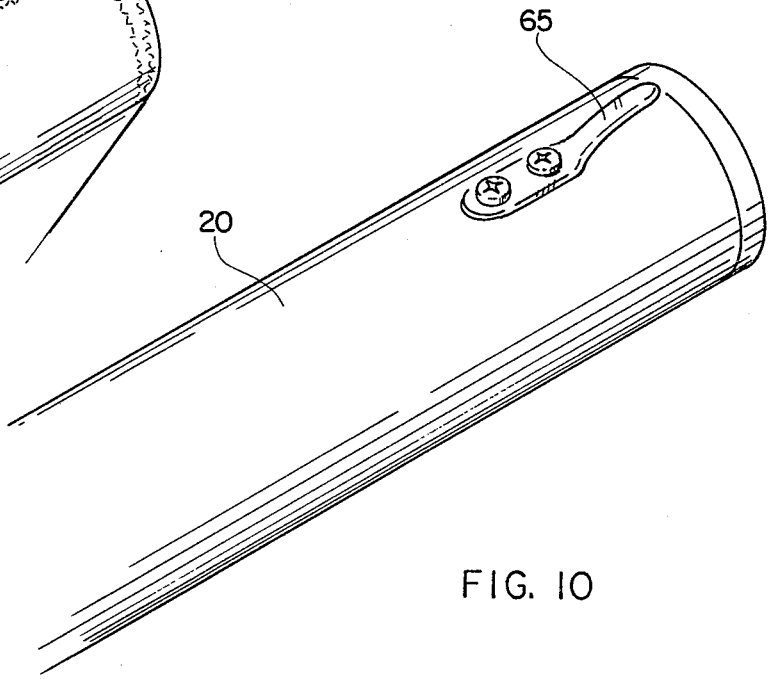
FIG. 10 is a fragmentary view revealing the construction preferably utilized at the upper end of the mast.

In order that the reefing can be accomplished satisfactorily, I utilize a hook 65 affixed near the top of the mast that serves as a "twist preventer"; note FIG. 10. The sail is provided with a sleeve to slip over the mast, with the hook being of such a design that it will not tear or abraid the sail.

Figure 11:
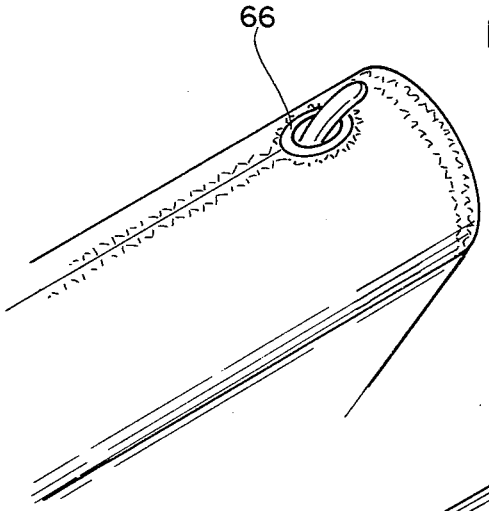
FIG. 11 is a view similar to FIG. 10 but showing the sail in place on the mast, and the grommet used for securing the sail to the twist preventer.

After the sail has been pulled over the mast, a grommet 66 which for example may be ⅜ inches in diameter, slides onto the twist preventer, thus effectively preventing the sail from sliding any further down the mast; note FIG. 11.

The downhaul holes 62 are utilized at the time reefing is to take place, and for example, prior to rotating the mast, the first downhaul position is attached by means of a ¼-inch line to cleat 64 mounted on the lower part of the mast 20; see FIG. 7. This attachment prevents the bottom part of the sail from twisting as the mast is rotated to cause the sail to be wrapped around the mast.

As may be anticipated, the second, third and fourth downhaul positions are used in conjunction with the second, third and fourth reef points. For example, when the sail is reefed to the second position, excess downhaul line is used to attach cleat 64 to the second downhaul position. When this is done, the line from downhaul position 1 to cleat 64 remains attached.

Figure 8:
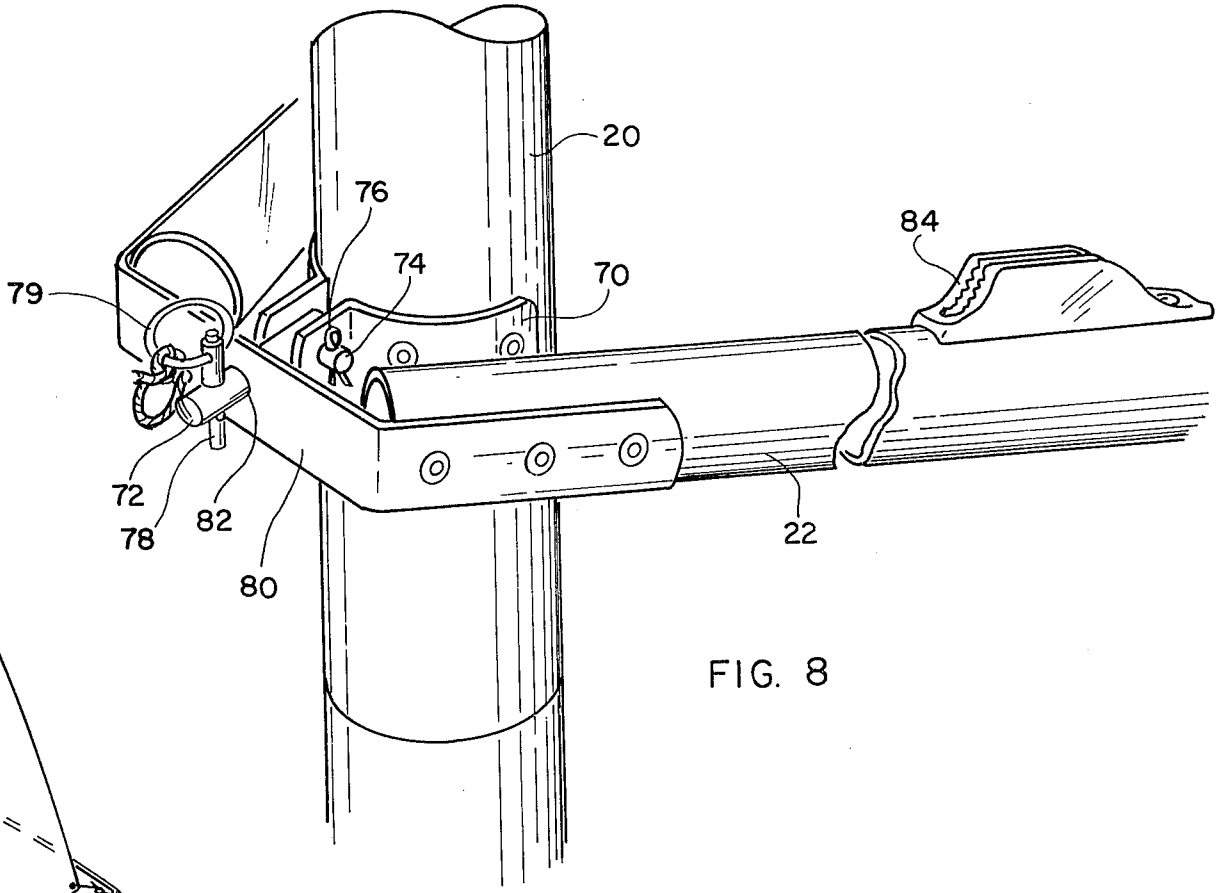
FIG. 8 is a view to a large scale of the arrangement by which the front end of the wishbone can be removably secured at a proper location on the mast.

Turning to FIG. 8, it will be seen that I have there shown the arrangement by which the wishbone 22 is releasably attached to the mast 20. A pair of straps 70 are attached such as by screws to the location on the mast corresponding to the proper position of the wishbone, and between these straps, a stainless steel pin 72 is mounted that is adapted to receive the wishbone. Rather than the pin being rigidly attached, it is instead supported by a smaller pin 74 about which pin 72 can rotate. A cotter key 76 prevents loss of the pin 74.

The front portions of the wishbone 22 are spanned by a stainless steel strap 80, which strap may be bolted to the wishbone members, but is preferably secured thereto by the use of pop rivets. A center hole 82 is provided in the strap 80 to receive the pin 72 when the wishbone is being attached in its operative position. The pin 78 can be slid into a hole provided in pin 72, in order to prevent the wishbone from undesirably separating from the mast. A finger ring 79 is utilized as a pulling ring to aid removal of the pin 78 on occasion.

Also visible in FIG. 8 is a clam cleat 84 mounted on the near arm of the wishbone 22, and it is to be understood that a substantially identical clam cleat is also mounted on the far arm of the wishbone. These are plastic devices with molded teeth, and are used to secure a line.

Figure 9:
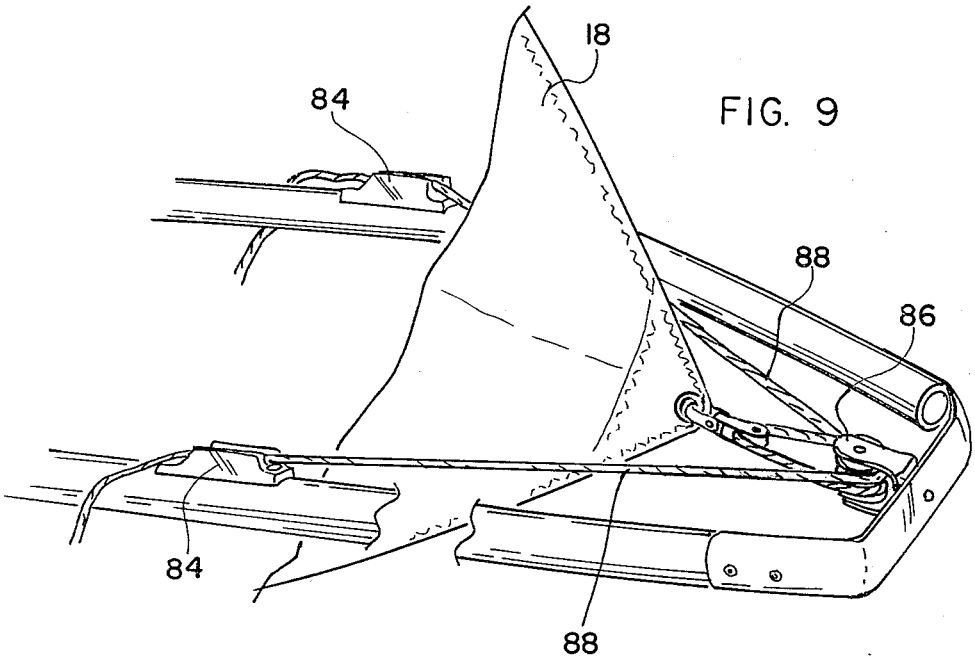
FIG. 9 is a simplified showing of the outhaul arrangement I use at the aft end of the wishbone in order to keep the sail taut to the desired extent.

Turning to FIG. 9, it will be noted that I have shown a type of outhaul arrangement usable at the aft end of my wishbone, in order that the sail 18 will be kept to a desired degree of tautness. As previously mentioned, a pair of clam cleats 84 are utilized on the forward part of the wishbone 22, and a double sheave pulley 86 is preferably utilized at the aft end of the wishbone. The mid portion of a line 88 is attached to the clew of the sail, with each end of the line passing through a respective portion of the double sheave. The line emerging in one direction from the sheave goes to one of the clam cleats, whereas the line emerging from the other side of the sheave goes to the other clam cleat. As should be quickly apparent, the degree of tautness of the sail can be adjusted from either side of the wishbone, and accomplished in a rapid and effective manner.

Turning to FIG. 10, it will be seen from this fragmentary view that I have revealed the upper portion of the mast 20, upon which is mounted a twist preventer hook 65, as previously mentioned. This hook is secured in position by suitable screws, and points upwardly so as to serve as the means for receiving the sail. The hook has no sharp edges that would tend to snag or tear the sail.

Referring to FIG. 11, it will be seen that I have shown the sleeve portion of the sail 18 inserted over the mast 20. When the sail is in the proper position on the mast, the previously mentioned grommet 66, positioned in the upper part of the sail, will coincide with the hook 65. At this point, the grommet can be pushed down over the free end of the hook. This arrangement facilitates a proper reefing of the sail when the amount of sail exposed to the wind is to be altered.

Figure 12:
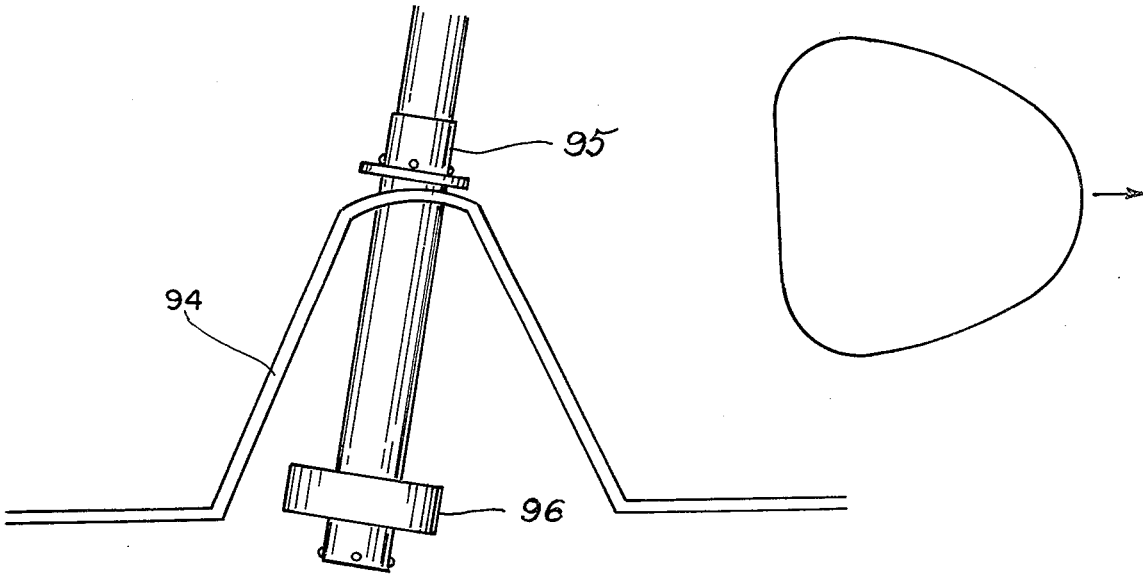
FIG. 12 is a cross-sectional view of an embodiment of my invention wherein the cone-shaped member is utilized apex up, base down.

With reference now to FIG. 12, it will be seen that I have here illustrated that the generally cone-shaped sail mounting member 94 in accordance with this invention can be mounted apex up on the deck of a boat. In this instance, the mast step tube (or the base of the mast itself) can be mounted directly in the apex of the cone member 94, with the lower portion of the mast step tube (or mast) being in a position to contact the base portion or sidewall portions of the cone-shaped member. As in the primary embodiment, a slidable collar 96 may be utilized on the mast step tube or mast, thus to control the amount of mast deflection that is permitted. Since in a manner of speaking, the collar here is in an interior portion of the cone, the collar in this embodiment cannot be as readily adjusted by the user as in the case where he can reach easily and directly into the interior of the cone-shaped member. It is to be realized that positioning the collar either toward or away from the apex of the cone-shaped member 94 has approximately the same effect as in the case of the cone-shaped member 24, mounted apex down. The base of cone 94 can be configured along the lines indicated in FIG. 5, but the cone configuration can be considered as being 180° away, in a fore and aft sense, from the configuration shown in FIG. 5.

In the embodiment of FIG. 12, I prevent the mast step tube (or mast) from dropping through the illustrated position with respect to cone 94, this preferably being accomplished by the use of a washer-like member 95 held in place by machine screws threaded into the wall of the tube. This washer-like member does not inhibit tilting type movements of the mast step tube or mast. Other machine screws threaded into the lowermost part of the tube prevent the collar 96 from undesirably sliding off.

Figure 13:
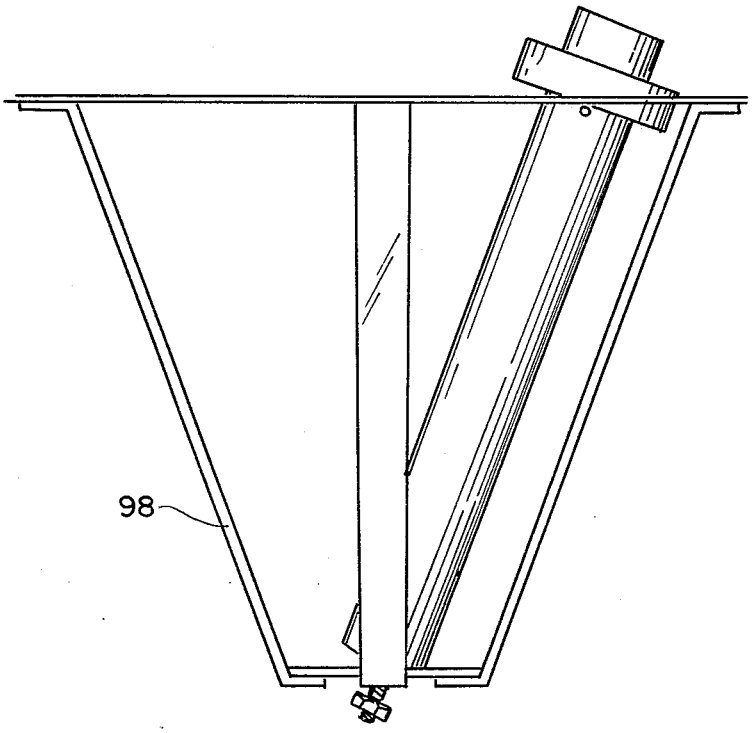
FIG. 13 is an embodiment in which the cone-shaped member does not utilize continuous sidewalls.

Turning to FIG. 13, it is to be seen that I obviously do not need to employ a cone-shaped member utilizing sidewalls. In this embodiment, the cone-shaped member 98 is defined by a plurality of straps of aluminum or fiberglass terminating at an apex point, which apex point serves as the support for the mast step tube or mast. As before, a swiveling type action of the supported member is possible, as is a rotation that will enable an effective reefing procedure to be carried out. The base portion of the cone-shaped member 98 is preferably configured in the same manner as illustrated in FIG. 5, and it serves to restrain tilting type movements of the mast to the angular range previously indicated. As before, a collar may be used on the mast step tube or mast, with machine screws being used to prevent the collar being slid below the position at which the base portion of the cone-shaped member 98 is contacted. However, the user can slide the collar above the position illustrated in FIG. 13 if he so desires.

As will now be understood, I have provided a novel, generally cone-shaped member designed to receive the base of a mast, or in which a mast step tube may be mounted for movements to a limited extent. The front interior portion of the cone-shaped member may be relatively straight across, and merging by the use of rounded contours with interior portions on each side of the front interior portion. The side interior portions of the cone-shaped member extend aft and merge at the aft center in a rounded contour of preferably greater radius than those of the aforementioned rounded contours. The interior portions of my cone-shaped member thus create a plurality of preestablished locations in which, during mast motions, the mast can be restrained, including positions forwardly and to the left, forwardly and to the right, and center aft.

When the mast (or mast step tube) is in the center aft position, it usually is in the circumstance of the boat going from a port tack to a starboard tack, or vice versa.

I claim:

1. In a wind propelled boat of the sailboard type, a generally cone-shaped sail mounting member secured on the deck of the boat, a portion of said generally cone-shaped member being designed to receive the base of a mast such that it will be movable only for a limited angular extent around interior portions of said generally cone-shaped member, means for securing a lower part of the mast in the apex of said generally cone-shaped member, the front interior of said generally cone-shaped member being relatively straight across, with said front interior merging by the use of rounded contours with interior portions to each side of said front portion, thereby to define preestablished locations therein, such that the mast can be moved to a preestablished location that is forward and to the left, or to a preestablished location that is forward and to the right, the interior of said generally cone-shaped member also presenting a rounded location in the aft center such that the mast can be supported and restrained by an interior surface of said generally cone-shaped member when the mast has been moved into any of a plurality of selected positions.

2. The generally cone-shaped sail mounting member as defined in claim 1 in which said cone-shaped member is secured apex down on the deck of the boat.

3. The generally cone-shaped sail mounting member as defined in claim 1 in which said cone-shaped member is secured apex up on the deck of the boat.

4. The generally cone-shaped sail mounting member as defined in claim 1 in which said securing means permits rotation of the mast such that the sail can be reefed.

5. In a wind propelled boat of the sailboard type, a generally cone-shaped sail mounting member secured on the deck of the boat, a mast step tube designed to receive the base of a mast, and being movably disposed in said cone-shaped member, a connector of a swivel type securing a part of said mast step tube in the apex of said cone-shaped member, the height of said mast step tube being similar to the height of the sidewalls of said cone-shaped member, the front interior of said generally cone-shaped member being relatively straight across, with said front interior merging by the use of rounded contours with interior portions to each side of said front portion, thereby to define preestablished locations therein, such that the mast step tube can be moved to a preestablished location that is forward and to the left, or to a preestablished location that is forward and to the right, the interior of said cone-shaped member also presenting a rounded location in the aft center such that the mast step tube can be supported and restrained by an interior surface of said generally cone-shaped member when the mast and mast step tube have been moved into any of a plurality of selected positions.

6. The generally cone-shaped sail mounting member as defined in claim 5 in which said cone-shaped member is secured apex down on the deck of the boat.

7. The generally cone-shaped sail mounting member as defined in claim 5 in which said cone-shaped member is secured apex up on the deck of the boat.

8. The generally cone-shaped sail mounting member as defined in claim 5 in which said securing means permits rotation of said mast step tube such that the sail can be reefed.

9. The sail mounting member as defined in claim 5 wherein a collar is mounted on said mast step tube, said collar being slidable to selected positions on said mast step tube, such that the angle of mast deflection can be selected and controlled within certain limits.

10. In a wind propelled boat of the sailboard type, a generally cone-shaped sail mounting member secured on the deck of the boat, a portion of said cone-shaped member being designed to receive the base of a mast such that it will be movable only for a limited angular extent in said cone-shaped member, means for securing a lower part of the mast in the apex of said cone-shaped member, said securing means permitting a swivel type motion such that a portion of the mast can approach, during mast motions, one or another of certain interior portions of said cone-shaped member, such that angular deflections of the mast will be effectively limited by said cone-shaped member, the front interior portion of said cone-shaped member being relatively straight across, and merging by the use of rounded contours with interior portions on each side of said front interior portion, said side interior portions of said cone-shaped member extending aft and merging at the aft center in a rounded contour of greater radius than those of the aforementioned rounded contours, the interior portions of said cone-shaped member thus creating a plurality of preestablished locations in which, during mast motions, the mast can be restrained, including positions forwardly and to the left, forwardly and to the right, and center aft.

11. The generally cone-shaped sail mounting member as recited in claim 10 in which said cone-shaped member is secured apex down on the deck of the boat.

12. The generally cone-shaped sail mounting member as recited in claim 10 in which said cone-shaped member is secured apex up on the deck of the boat.

13. The cone-shaped sail mounting member as recited in claim 10 in which said means for securing the lower part of the mast in the apex of said cone-shaped member is a mast step tube whose height is similar to the height of the sidewalls of said cone-shaped member.

14. The cone-shaped sail mounting member as recited in claim 13 in which a collar is mounted on said mast step tube, said collar being slidable to selected positions on said mast step tube, such that the angle of mast deflection can be selected and controlled within certain limits.

15. The cone-shaped sail mounting member as defined in claim 13 in which said mast step tube is rotatable to permit the mast to be rotated such that the sail can be reefed.

16. In a wind propelled boat of the sailboard type, a generally cone-shaped sail mounting member secured apex down in the deck of the boat, a mast step tube designed to receive the base of a mast and movably disposed in said cone-shaped member, a connector of a swivel type securing the lowest portion of said mast step tube in the apex of said cone-shaped member, the height of said mast step tube being similar to the height of the sidewalls of said cone-shaped member, said connector permitting a swivel type motion such that the mast step tube can approach, during mast motions, any of a number of interior surfaces of said cone-shaped member, the upper interior portion of said cone-shaped member being generally triangular when viewed from above, with the front interior of said cone-shaped member being relatively straight across, with said front interior merging by the use of rounded contours with interior portions to each side of said front portion, thereby to define preestablished locations therein, such that the mast step tube and mast can be moved to a preestablished location that is forward and to the left, or to a preestablished location forward and to the right, the interior of said generally cone-shaped member also presenting a rounded location in the aft center such that the mast step tube and mast can be supported and restrained by interior surfaces of said generally cone-shaped member when moved into any of a plurality of selected positions.

17. The generally cone-shaped sail mounting member as defined in claim 16 wherein a collar is mounted on said mast step tube, said collar being slidable to selected positions on said mast step tube, such that the angle of mast deflection can be selected and controlled within certain limits.

18. The generally cone-shaped sail mounting member as defined in claim 16 in which said mast step tube is rotatable to permit the mast to be rotated such that the sail can be reefed.

19. In a catamaran having a pair of pontoons joined by a cross arm, a generally cone-shaped sail mounting member secured apex down on the cross arm, a mast step tube designed to receive the base of a mast and movably disposed in said cone-shaped member, a connector of a swivel type securing the lowest portion of said mast step tube in the apex of the cone-shaped member, the height of said mast step tube being similar to the height of the sidewalls of said cone-shaped member, said connector permitting a swivel type motion such that the mast step tube can approach, during mast motions, one or another of several locations preestablished in the interior of said cone-shaped member, the front interior portion of said cone-shaped member being relatively straight across, and merging by the use of rounded contours with interior portions on each side of said front interior portion, said side interior portions of said cone-shaped member extending aft and merging at the aft center in a rounded contour of somewhat greater radius than those of the aforesaid rounded contours, the interior portions of said cone-shaped member thus creating said several preestablished locations in which, during mast motions, the mast can be restrained, including positions forwardly and to the left, forwardly and to the right, and center aft.

20. The sail mounting member as defined in claim 19 wherein a collar is mounted on said mast step tube, said collar being slidable to selected positions on said mast step tube, such that the angle of mast deflection can be selected and controlled within certain limits.

21. The sail mounting member as defined in claim 19 in which said mast step tube is rotatable to permit the mast to be rotated such that the sail can be reefed.

* * * * *